United States Patent [19]

Pomponi, Jr.

[11] Patent Number: 4,526,191

[45] Date of Patent: Jul. 2, 1985

[54] FLUID SUPPLY CONTAINER FOR COLOR CHANGER

[75] Inventor: Edward A. Pomponi, Jr., Boulder, Colo.

[73] Assignee: Binks Manufacturing Company, Franklin Park, Ill.

[21] Appl. No.: 527,862

[22] Filed: Aug. 30, 1983

[51] Int. Cl.[3] ..... B67D 5/52

[52] U.S. Cl. ..... 137/206; 137/226; 222/136; 222/144.5

[58] Field of Search ..... 137/206, 209, 226; 222/136, 135, 144.5

[56] References Cited

U.S. PATENT DOCUMENTS

| | | | |
|---|---|---|---|
| 2,992,757 | 7/1961 | Richards | 137/209 |
| 3,519,168 | 7/1970 | Carr et al. | 222/132 |
| 3,593,888 | 7/1971 | Brown | 222/132 |
| 3,811,457 | 5/1974 | Crossman | 137/226 |
| 4,238,054 | 12/1980 | Chen | 222/136 X |
| 4,397,422 | 8/1983 | Gwyn | 222/136 X |

*Primary Examiner*—Henry Bennett

*Attorney, Agent, or Firm*—Gary, Juettner & Pyle

[57] ABSTRACT

A container for holding a plurality of supplies of fluids of different colors for being provided to a color changer connected with spray painting equipment, is characterized by a canister in which is contained a plurality of bottles containing the fluids. Caps on the bottles have outlets connected through associated fluid supply tubes with inlets to the color changer, and vent holes are formed through the caps. The interior of the canister is maintained at a selected pressure, so that by virtue of the vent holes in the bottle caps the interiors of the bottles are pressurized and the fluids are supplied under pressure through their associated tubes to the color changer.

15 Claims, 6 Drawing Figures

26
32
20
36
74
68
42
40
70
106
38
24
108
78
102
76
98
72
22
96
90
96
96
86
84
88
80
94
92
82
60
66
80
64
62

FLUID SUPPLY CONTAINER FOR COLOR CHANGER

BACKGROUND OF THE INVENTION

The present invention relates to a container for supplying under pressure a plurality of fluids of different colors to a color changer for spray painting equipment.

Airbrushes are commonly used by commercial artists and photographers to apply color and shading to drawings, prints and photographs, to accentuate highlights and to supply backgrounds to films, as well as by hobbyists for painting models and projects. An airbrush is usually shaped like a pencil, and as is well known utilizes air to atomize a fluid in a controlled pattern for deposit on an article.

In use of a typical airbrush, a bottle containing fluid of a color to be applied is connected to the airbrush. The bottle has an outlet hole in its cap through which fluid is aspirated into a fluid inlet to the gun and a vent hole through which air is drawn as the bottle empties so that a vacuum does not occur in the bottle and defeat further aspiration of fluid. Compressed air coupled to the airbrush passes through a small orifice adjacent the fluid inlet to the airbrush and draws the fluid out of the bottle due to the low pressure region developed across the bottle outlet as a result of venturi effect. The flow of air then atomizes the fluid into droplets and applies it onto the surface being colored.

Prior airbrush and bottle assemblies have numerous drawbacks. For each different color or blend of colors a different bottle has to be attached to the airbrush, and in the case of a blend of colors different fluids must first be mixed together. The technique is time consuming and tedious, and interrupts the flow of working with the airbrush. In addition, between color changes, a bottle of solvent has to be connected with the airbrush for flushing purposes. Moreover, the outlet holes from the bottles have a tendency to become plugged when relatively viscous fluids are used, as well as the vent holes due to the fluid being moved across the vents from the motion of the bottle during airbrushing.

To overcome the aforementioned disadvantages of airbrush and bottle assemblies, a color changer which selectively supplies different colors of fluid or a solvent to an airbrush may be used. In use of a color changer, bottles containing the fluids to be sprayed, such as bottles of ink of different colors, connect through associated fluid supply lines with inlets to the color changer, so that one or more of the fluids may be selected for supply to the airbrush. Inasmuch as it has heretofore been necessary to rely upon venturi effect to aspirate fluids into the airbrush for being atomized into a spray, so that the venturi effect will be sufficient to draw fluids into the airbrush the supply bottles of fluid must be maintained at about the working level of the airbrush. The net result is that the vertical working range of the airbrush is drastically limited, since if it is elevated sufficiently above the supply bottles, the vacuum generated by venturi effect will not be strong enough to overcome gravity and draw the fluids into the airbrush, and spraying will cease.

The arrangement also results in unacceptable variations in the flow rate of fluids to the airbrush. As the airbrush is lowered from its maximum operational height, at which point a minimal flow rate of fluids is available, the flow rate increases because of the decreasing gravitational effect which must be overcome, and continues to increase as the airbrush is lowered to and below the level of the bottles, at which point the fluids are brought to an increasingly positive pressure by gravity. In consequence, the rate at which fluids are sprayed is extremely difficult if not impossible to control, and for satisfactory results all airbrushing must be performed at a substantially constant vertical level.

OBJECT OF THE INVENTION

The primary object of the present invention is to provide a container for holding a plurality of supplies of fluids of different colors and for providing the fluids under a substantially constant pressure to a color changer for spray painting equipment.

SUMMARY OF THE INVENTION

In accordance with the present invention, a container for holding a plurality of vented supplies of fluid having fluid outlets, and for providing the fluids under pressure at an outlet from said container, comprises a canister for holding a plurality of the supplies of fluid and a removable cover mounted on and closing said canister in sealed relationship therewith. A plurality of conduit means are extendable between associated ones of the fluid supply outlets and an outlet in one of said canister and cover, and means is provided for introducing a pressurized gas into said canister to develop a positive pressure of gas therein and in the supplies through the vents thereof to force the fluids through the fluid supply outlets and said plurality of conduit means to said outlet in one of said cover and canister.

The foregoing and other ojbects, advantages and features of the invention will become apparent from a consideration of the following detailed description, when taken in conjunction with the accompanying drawings.

DETAILED DESCRIPTION

Figure 1:
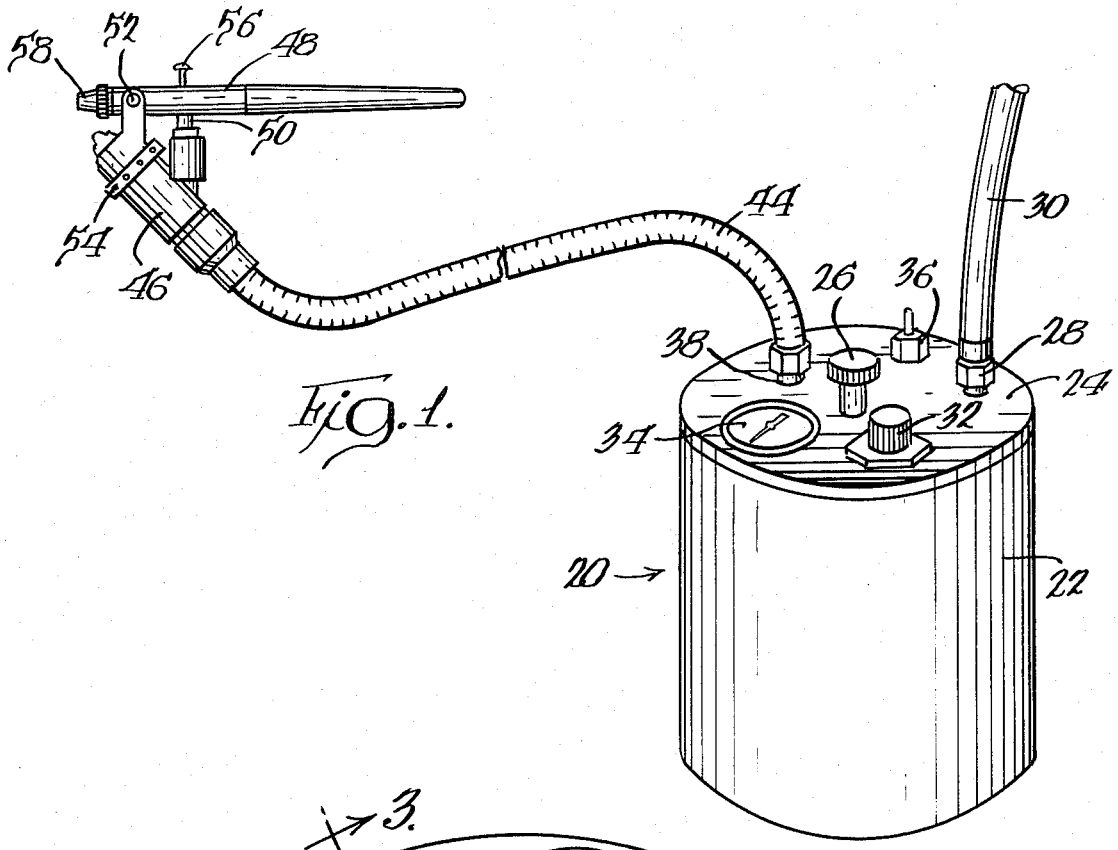
FIG. 1 is a perspective view of a fluid supply container in accordance with the teachings of the invention, showing the same connected to supply different colors of fluid to a color changer for an airbrush.
Figure 2:
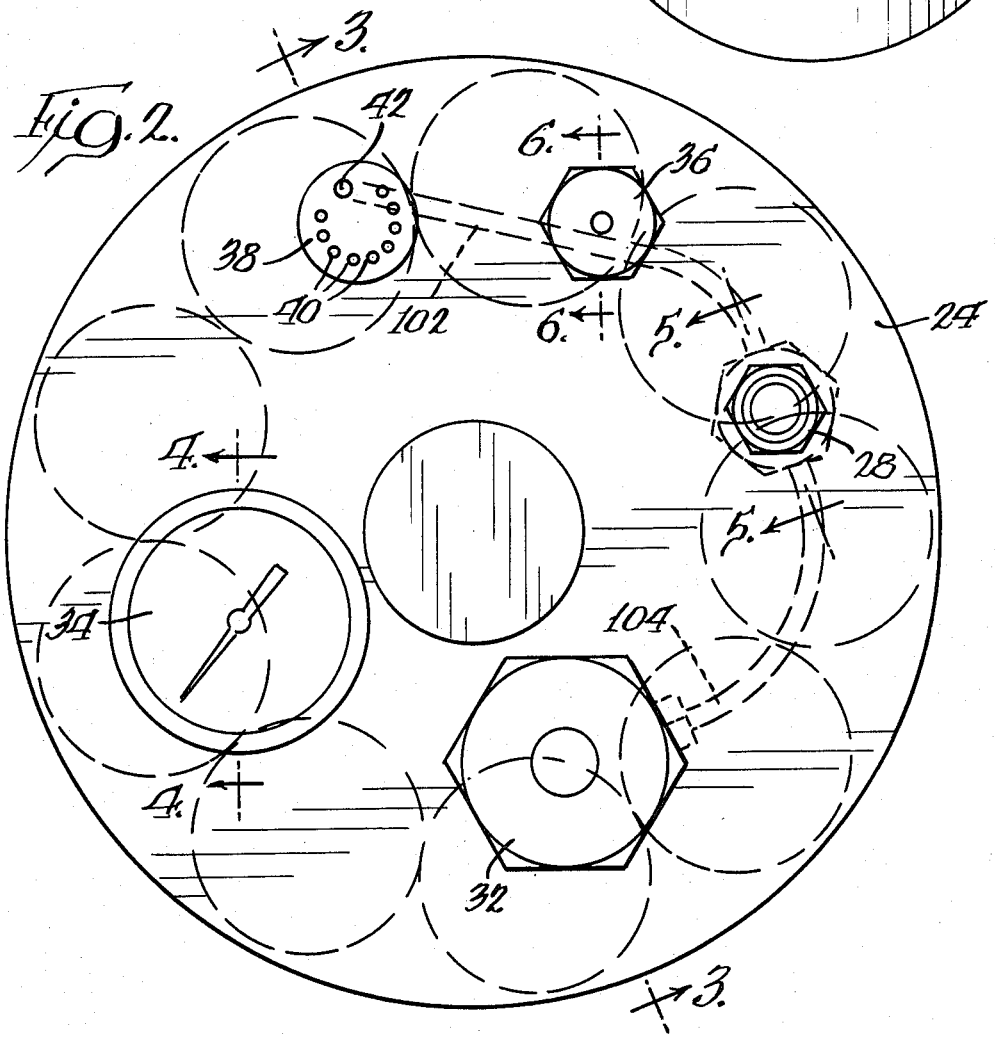
FIG. 2 is a top plan view of the fluid supply container.

In FIG. 1 there is indicated generally at 20 a fluid supply container in accordance with the teachings of the present invention. The container includes a lower cylindrical canister 22 in which is maintained a plurality of vented supplies of fluids of different colors, such as a plurality of supplies of inks, and a lid 24 is on and closes the canister. The lid carries a knob 26 by means of which it may be fastened on and in sealed relationship with the canister or removed therefrom. The lid also carries an air inlet connector 28 connected with a supply of pressurized air (not shown) through a line 30, an air pressure regulator 32 for controlling the pressure of air in the canister, a pressure gauge 34 for indicating the pressure in the canister and a pressure relief valve 36 for limiting the pressure to a maximum selected value.

Because of the positive pressure of air within the canister 22, the fluids from the supplies thereof are provided under a positive pressure to a color changer for a spray painting apparatus. The lid 24 therefore also carries a hose bundle connector 38 having formed therethrough a plurality of fluid conveying passages 40 and an air conveying passage 42 for connection with one end of a flexible conduit 44 which, although not shown, contains therewithin a plurality of fluid supply tubes each connected with an associated one of the fluid conveying passages 40 and an air supply tube connected with the air conveying passage 42. At an opposite end of the flexible conduit the fluid and air supply tubes connect with associated inlets to a color changer 46 mounted on an airbrush 48. The airbrush has an air inlet 50 for connection through the color changer with the air supply tube and a fluid inlet 52 which is selectively connectable through the color changer, by means of rotating a selector knob 54, with one or more of the fluid supply tubes. The airbrush also has an actuating knob 56, which when depressed admits air into the airbrush for being emitted from a nozzle 58 and, which when also pulled back, allows fluid to enter the airbrush for being emitted from the nozzle in an atomized spray. It is to be appreciated that the color changer and airbrush do not themselves form a part of the present invention, but have been illustrated and described solely to show a particularly advantageous use for the fluid supply container.

Figure 3:
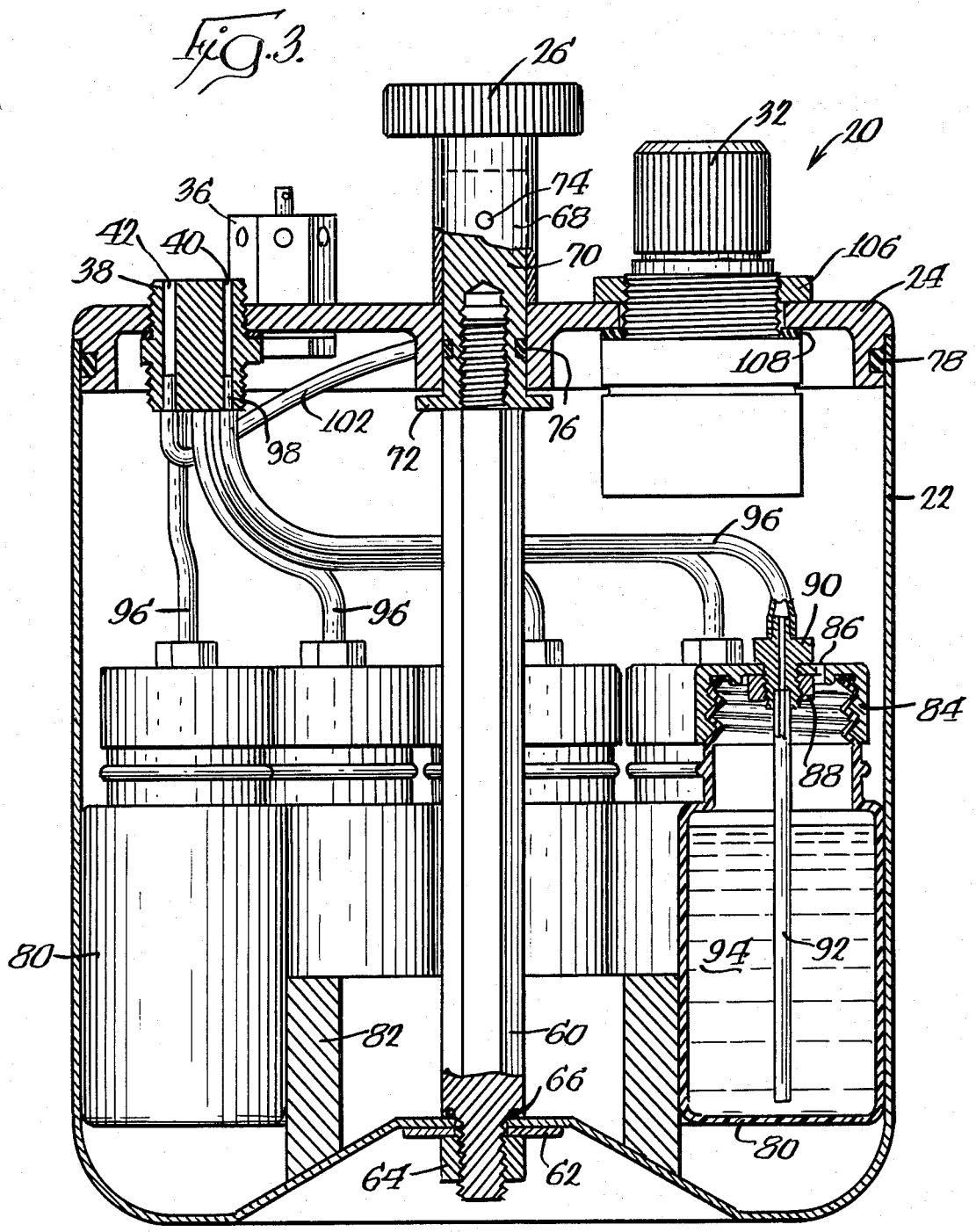
FIG. 3 is a cross sectional side elevation view taken substantially along the lines 3—3 of FIG. 2, and shows structural details of the container and the arrangement of a plurality of fluid supply bottles therein.
Figure 4:
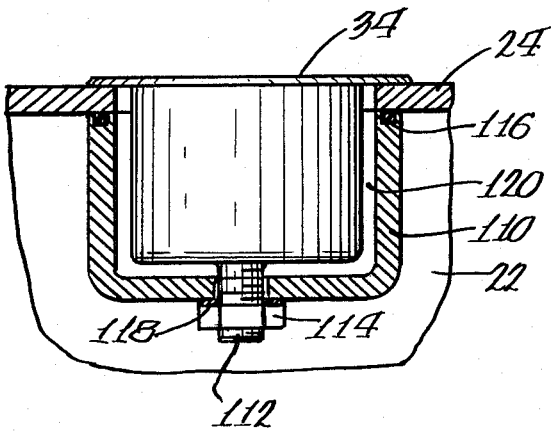
FIG. 4 is a cross sectional view taken substantially along the lines 4—4 of FIG. 2, and illustrates the mounting of a pressure gauge in a lid of the container.

As shown in FIG. 3, a stud 60 for mounting the cover or lid 24 on the canister 22 extends axially through the canister. A threaded lower end of the stud is secured to a raised area of the canister bottom wall by means of a flat washer 62 and a nut 64 and is sealed to the wall by an O-ring 66, and a threaded upper end of the stud is connectable and disconnectable with and from the knob 26 to permit mounting and removal of the lid on and from the canister. The knob includes a cylindrical extension 68 in which is received a cylindrical seal retainer 70. The lower end of the seal retainer has a radial flange 72 to prevent its withdrawal from the lid, and a dowel pin 74 extends through the cylindrical extension and the seal retainer, so that upon rotation of the knob the seal retainer is rotated within the lid passage for being threaded onto and off of the upper end of the stud. An O-ring 76 carried by the seal retainer closes the passage through the lid and an O-ring 78 carried by the lid seals the lid to the canister.

For the embodiment of invention shown, the supplies of fluid are in bottles 80 arranged around and carried by a bottle retainer 82 supported on the bottom of the canister 22. Nine bottles may be within the canister, eight of which contain fluids of different colors and one a solvent for the fluids to facilitate cleaning the color changer and airbrush. Each bottle has a cap 84 through which a vent hole 86 is formed, and extending through a central passage in each cap and secured to the cap by a nut 88 is a tube mount 90. The lower end of each tube mount carries a tube 92 which extends toward the bottom of the bottle, so that substantially all of the fluid 94 within the bottle may be withdrawn. The upper end of each tube mount connects through an associated fluid supply tube 96 and fluid pin 98 with a respective one of the fluid conveying passages 40 through the hose bundle connector 38, whereby the individual colors of fluids and solvent may be separately delivered to the color changer.

Figure 5:
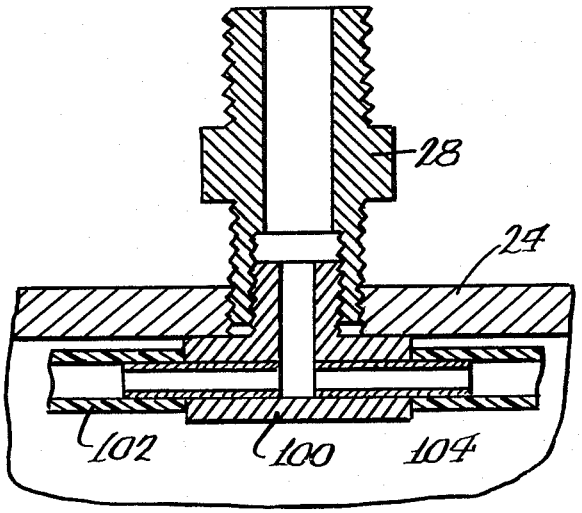
FIG. 5 is a cross sectional view taken substantially along the lines 5—5 of FIG. 2, and shows an air inlet whereat air is introduced into the container.
Figure 6:
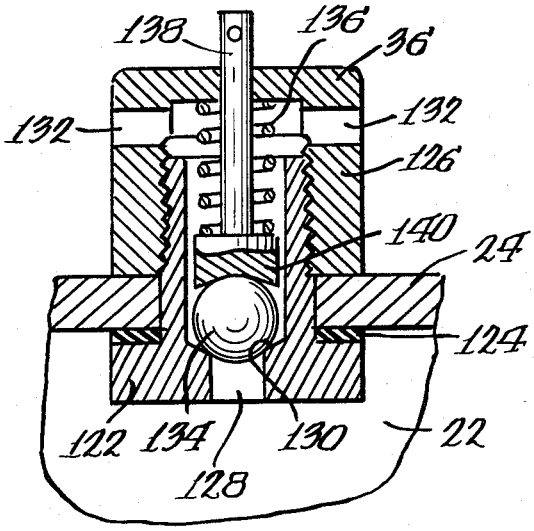
FIG. 6 is a cross sectional view taken substantially along the lines 6—6 of FIG. 2, and shows one type of pressure relief valve which may be used to limit the pressure within the container to a selected maximum value.

To pressurize the container 20 to a regulated value and at the same time provide a supply of air through the flexible conduit 44 and color changer 46 for introduction into the airbrush 48, as also shown in FIG. 5 the air inlet connector 28 is threaded into a passage through the lid 24 and connects at its lower end with an air inlet tee 100. One side of the tee is coupled through an air supply tube 102 with the air conveying passage 42 through the hose bundle connector 38, and thence through the flexible conduit and the color changer with the air inlet to the airbrush. The other side of the tee connects through a tube 104 to an inlet to the air pressure regulator 32, which regulator is mounted in a passage through the lid by means of a nut 106, is sealed with the lid by a gasket 108, and has an outlet disposed to the interior of the canister. Consequently, by appropriate adjustment of the regulator, the pressure of the air within the canister may be maintained at a selected value.

To provide an indication of the pressure of air within the canister, the pressure gauge 34 is received within a passage through the lid 24 with a radially extending flange at its upper end resting on the lid. To hold the gauge in place, a pressure gauge retainer 110 is connected with a pressure sensing inlet 112 to the gauge by a nut 114 and is sealed at its upper end to the lower lid surface by a gasket 116. An annular seal 118 is between the nut and pressure gauge retainer, whereby a space 120 between the pressure gauge and retainer is maintained at atmospheric pressure, so that the gauge provides accurate readings of the pressure of air within the canister.

To prevent the pressure of air in the container from exceeding a maximum permissible value and possibly rupturing the container, the pressure relief valve 36 includes a relief seat 122 extended through a passage in the lid 24 and sealed with the lid by a gasket 124, and a spring retainer 126 threaded onto the relief seat and securing it in place on the lid. A passage 128 through the relief seat has a valve seat 130 at its lower end, and communicates with a plurality of vent openings 132 in the spring retainer. A relief ball 134 within the passage rests on the valve seat, and is urged against the seat by a compression spring 136 extended around a plunger 138 and captured between an enlarged plunger head 140 and an upper end of the spring retainer. The compression characteristics of the spring are selected so that the spring normally urges the relief ball against its seat to seal the passage for all pressures of air within the canister which are less than the maximum permissible value, but allows the relief ball to be moved by pressure of air from the seat to open the passage and relieve the pressure within the canister should it exceed the maximum value. To relieve all of the pressure of air within the canister, for example for the purpose of removing the lid, the plunger may simply be manually pulled in the direction away from the relief ball.

Because of the pressure of air within the container and the vent holes 86 in the bottle caps 84, a positive pressure is developed within the bottles which provides a pressure feed of the fluids through the fluid supply tubes 96, the fluid conveying passages 40 in the hose bundle connector 38, the flexible conduit 44 and the color changer 46 to the airbrush 48. The forces exerted on the fluids by the pressurized air are much greater than those exerted by gravity in either the rearward or forward direction of fluid flow depending upon whether the airbrush is elevated or lowered with respect to the supply bottles, with the result that gravitational influences on the flow rate of fluids to the airbrush are negligible with changes in elevation of the airbrush, and a very constant and uniform supply rate of fluids is maintained for highly controlled airbrushing. At the same time, the delivery rate of fluids can be adjusted by the setting of the regulator 32, and because of the positive pressures developed, airbrushing may occur even when the airbrush is considerably elevated above the fluid supplies.

In addition, the container 20 provides a very convenient means for holding the plurality of fluid supplies and moving them about from one work location to another. Protection is afforded against leakage or breakage of the fluid supply bottles, and if any leakage should occur, for example by the fluid supply container being knocked over, spilled fluids will be retained in the container and there will be no danger of damage to the article being painted or the surrounding work area. Although for convenience of illustration the fluid supply tubes 96 extending from the bottles are shown as having lengths which just reach the hose bundle connector 38, it is understood that in practice the tubes would have a length sufficient to allow convenient removal of the lid 24 from the canister 22 without disturbing the resting of the bottles 80 within the bottle retainer 82.

While one embodiment of the invention has been described in detail, various modifications and other embodiments thereof may be devised by one skilled in the art without departing from the spirit and scope of the invention, as defined in the appended claims.

What is claimed is:

1. A container for holding a plurality of bottles of fluid of different colors and having vented caps and fluid outlets in the caps, and for providing the fluids under pressure at an outlet from said container, said container comprising a canister; bottle retaining means in said canister for receiving and holding the plurality of the bottles of fluid; a removable cover mounted on and closing said canister in sealed relationship therewith; an outlet connector extending through one of said canister and cover and having a plurality of fluid conveying passages therethrough; a plurality of flexible conduit means each connectable between an associates one of the bottle cap fluid outlets and a respective one of said fluid conveying passages; and means for introducing pressurized air into said canister to deveop a positive pressure of air therein and in all of the bottles through the vents thereof to force the fluids in the bottles through the fluid outlets in the caps and through said plurality of conduit means to said outlet connector fluid conveying passages, whereby said fluid conveying passages each receive fluid from an associated one of said bottles.

2. A container for holding a plurality of vented supplies of different colors of fluids having fluid outlets, and for providing the fluids under pressure at an outlet from said container, said container comprising a canister for holding a plurality of the supplies of fluid; a removable cover mounted on and closing said canister in sealed relationship therewith; a plurality of flexible conduit means, each extendable between an associated one of the fluid supply outlets and an outlet in one of said canister and cover; and means for introducing a pressurized gas into said canister to develop a positive pressure of gas therein and in the supplies through the vents thereof to force the fluids through the fluid outlets and said plurality of conduit means to said outlet in one of said cover and canister, wherein said outlet comprises an outlet connector having a plurality of separate fluid conveying passages therethrough, said conduit means extending between the associated ones of the fluid supply outlets and respective ones of said fluid conveying passages, whereby a selected different one of the fluids is provided under pressure to each of said fluid conveying passages.

3. In combination with a color changer for spray painting equipment, wherein said color changer is adapted to receive different colors of fluid at individual inlets thereto and to supply a selected one or more of the fluids to the spray painting equipment, a container for holding a plurality of bottles of the different colors of fluids and for supplying the fluids under pressure to the color changer inlets, said container comprising a canister; bottle retaining means in said canister for holding a plurality of the bottles of different colors of fluids, wherein the bottles have vented caps and fluid outlets in the caps; a removable cover mounted on and closing said canister in sealed relationship therewith; a fluid outlet connector extending through said cover and having a plurality of separate fluid conveying passages extending therethrough; a plurality of flexible fluid conveying conduits each connected between an associated one of the bottle cap outlets and a respective one of said fluid conveying passages; means for fluidically connecting individual ones of said fluid conveying passages with associated ones of said color changer inlets; and means for introducing air under pressure into said canister to develop a positive pressure of air therein and in all of the bottles through the vents to force the fluids in the bottles under a positive pressure to respective ones of said color changer inlets.

4. A container as in claim 2, including gas conveying conduit means extending between said means for introducing and said outlet for conveying gas under pressure to said outlet.

5. A container as in claim 2, wherein said outlet connector has a gas conveying passage therethrough, and including a further conduit means extending between said means for introducing and said gas conveying passage for providing gas under pressure to said gas conveying passage.

6. A container as in claim 1, wherein said outlet connector extends through said cover.

7. A container as in claim 1, wherein said means for introducing includes pressure regulator means mounted on said cover for regulating the pressure of air in said canister.

8. A container as in claim 1, including means mounted on said cover for indicating the pressure of air in said canister.

9. A container as in claim 1, including means mounted on said cover for limiting the pressure of air in said canister to a maximum selected value.

10. A container as in claim 9, wherein said means for limiting is manually operable to release the pressure of air in said canister.

11. A container as in claim 1, wherein said canister is generally cup-shaped and has a generally circular base wall and a cylindrical side wall and said cover is circular, and including a post connected at a lower end to said base wall and extending at an upper end to about the upper end of said cylindrical side wall and generally coaxial therewith, and manually operable latching means for securing said cover to said upper end of said post to mount said cover on said canister.

12. The combination as in claim 3, wherein said means for introducing introduces air under pressure through said cover and includes a pressure regulator for controlling the pressure of air in said canister.

13. The combination as in claim 12, including a pressure gauge carried by said cover for indicating the pressure of air in said canister.

14. The combination as in claim 13, including pressure limiting means carried by said cover for limiting the pressure of air in said canister to a maximum selected value.

15. The combination as in claim 3, wherein said fluid outlet connector also includes an air conveying passage extending therethrough, and including air conveying conduit means extending between said means for introducing and said air conveying passage; an air inlet passage to said color changer, separate from all of said fluid inlets, for coupling air under pressure to said spray painting equipment; and means for coupling air in said air conveying passage with said air inlet passage to said color changer.

* * * * *